US009714660B1

(12) United States Patent
Girdley

(10) Patent No.: US 9,714,660 B1
(45) Date of Patent: Jul. 25, 2017

(54) AQUATIC FAN DEVICE

(71) Applicant: Larry Girdley, Gamaliel, MO (US)

(72) Inventor: Larry Girdley, Gamaliel, MO (US)

( * ) Notice: Subject to any disclaimer, the term of this patent is extended or adjusted under 35 U.S.C. 154(b) by 756 days.

(21) Appl. No.: 14/146,832

(22) Filed: Jan. 3, 2014

(51) Int. Cl.

| | |
|---|---|
| ***F04D 3/00*** | (2006.01) |
| ***F04D 29/64*** | (2006.01) |
| ***F04D 13/08*** | (2006.01) |
| ***F04D 19/00*** | (2006.01) |
| ***F04D 29/08*** | (2006.01) |
| ***F04D 29/70*** | (2006.01) |

(52) U.S. Cl.
CPC ..... *F04D 19/002* (2013.01); *F04D 29/086* (2013.01); *F04D 29/648* (2013.01); *F04D 29/708* (2013.01)

(58) Field of Classification Search
CPC ..... F04D 13/08; F04D 13/086; F04D 19/002; F04D 29/648; F04D 3/005; F04D 29/708
USPC ..... 415/121.2; 417/423.15, 361, 61, 423.3, 417/424.1, 424.2
See application file for complete search history.

(56) References Cited

U.S. PATENT DOCUMENTS

| | | | | |
|---|---|---|---|---|
| 3,606,567 | A * | 9/1971 | Stahle | A01K 79/00 415/121.2 |
| 3,941,154 | A | 3/1976 | Bishop | |
| 4,189,791 | A | 2/1980 | Dundas | |
| 4,302,162 | A * | 11/1981 | Springston | E02B 15/02 405/61 |
| 4,658,757 | A | 4/1987 | Cook | |
| 5,441,368 | A * | 8/1995 | Campbell | E02B 17/0017 114/222 |
| 6,036,444 | A * | 3/2000 | Barney | F04D 29/703 415/121.2 |
| 6,138,294 | A | 10/2000 | Desjoyaux et al. | |
| 6,220,830 | B1 * | 4/2001 | Bzorgi | F04D 19/002 417/411 |
| D449,369 | S | 10/2001 | Hanzel et al. | |
| 7,118,307 | B2 | 10/2006 | Stoecker et al. | |
| 7,624,589 | B1 | 12/2009 | Argovitz | |
| 2001/0047539 | A1 | 12/2001 | Lynn | |

* cited by examiner

*Primary Examiner* — Christopher Verdier
*Assistant Examiner* — Brian O Peters

(57) ABSTRACT

An aquatic fan device for positioning under a water surface directs cooler water towards the water surface to cool an area for comfortable swimming. The device includes a tube and a line having a first end coupled to the tube such that the line supports the tube in a vertical position when the tube hangs from the line. The line extends from the tube wherein the line suspends the tube within a body of water under a surface of the body of water. A propeller is coupled to the tube and positioned within the tube between a top end and a bottom end of the tube. A submersible motor is coupled to and rotates the propeller such that the propeller is urges water upwardly through the tube towards the surface of the body of water.

11 Claims, 4 Drawing Sheets

AQUATIC FAN DEVICE

BACKGROUND OF THE DISCLOSURE

Field of the Disclosure

The disclosure relates to fan devices and more particularly pertains to a new fan device for positioning under a water surface to direct cooler water towards the water surface to cool an area for comfortable swimming.

SUMMARY OF THE DISCLOSURE

An embodiment of the disclosure meets the needs presented above by generally comprising a tube and a line having a first end coupled to the tube such that the line supports the tube in a vertical position when the tube hangs from the line. The line extends from the tube wherein the line suspends the tube within a body of water under a surface of the body of water. A propeller is coupled to the tube and positioned within the tube between a top end and a bottom end of the tube. A submersible motor is coupled to and rotates the propeller such that the propeller is urges water upwardly through the tube towards the surface of the body of water.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
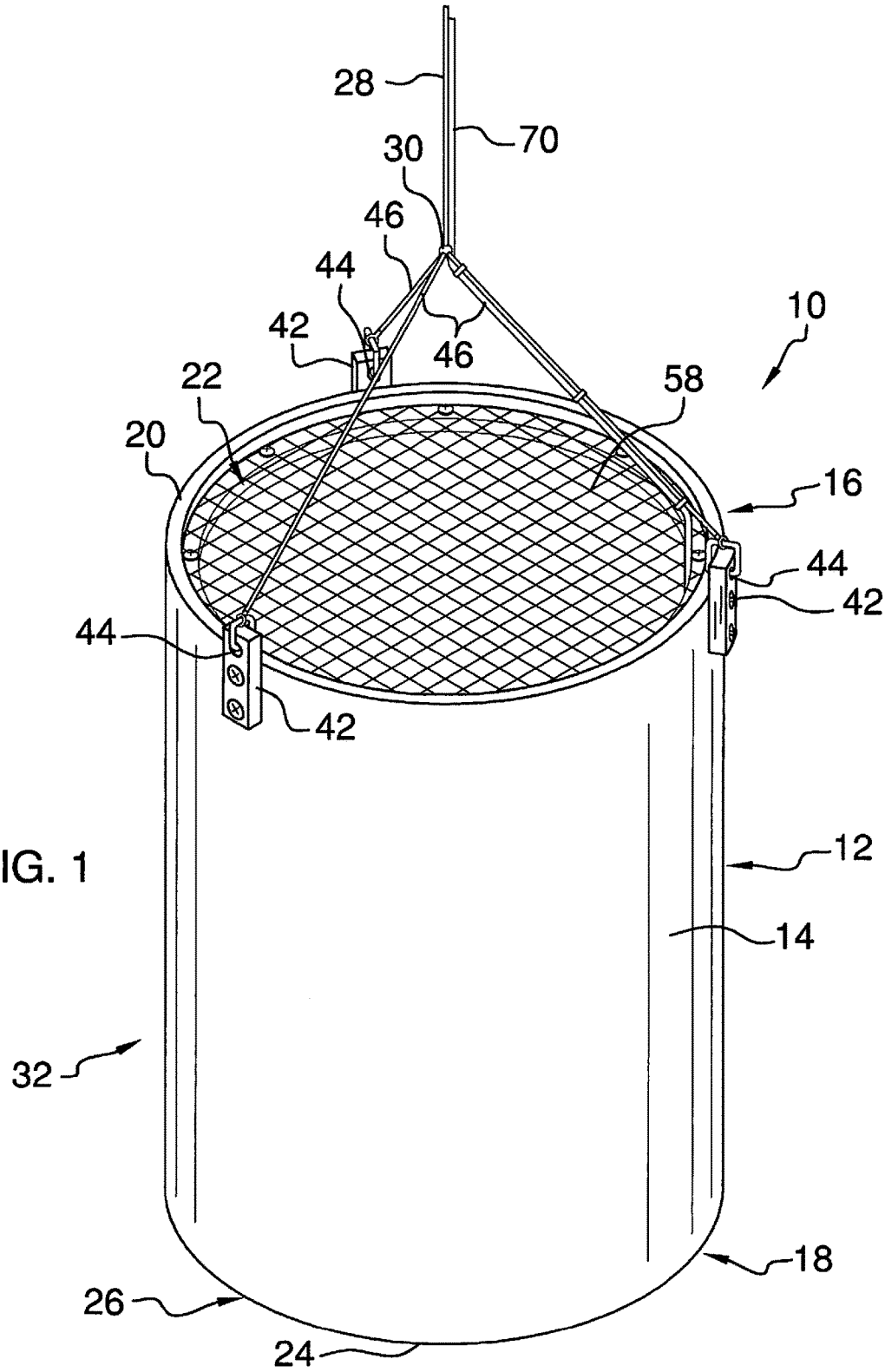
FIG. 1 is a top front side perspective view of a aquatic fan device according to an embodiment of the disclosure.
Figure 2:
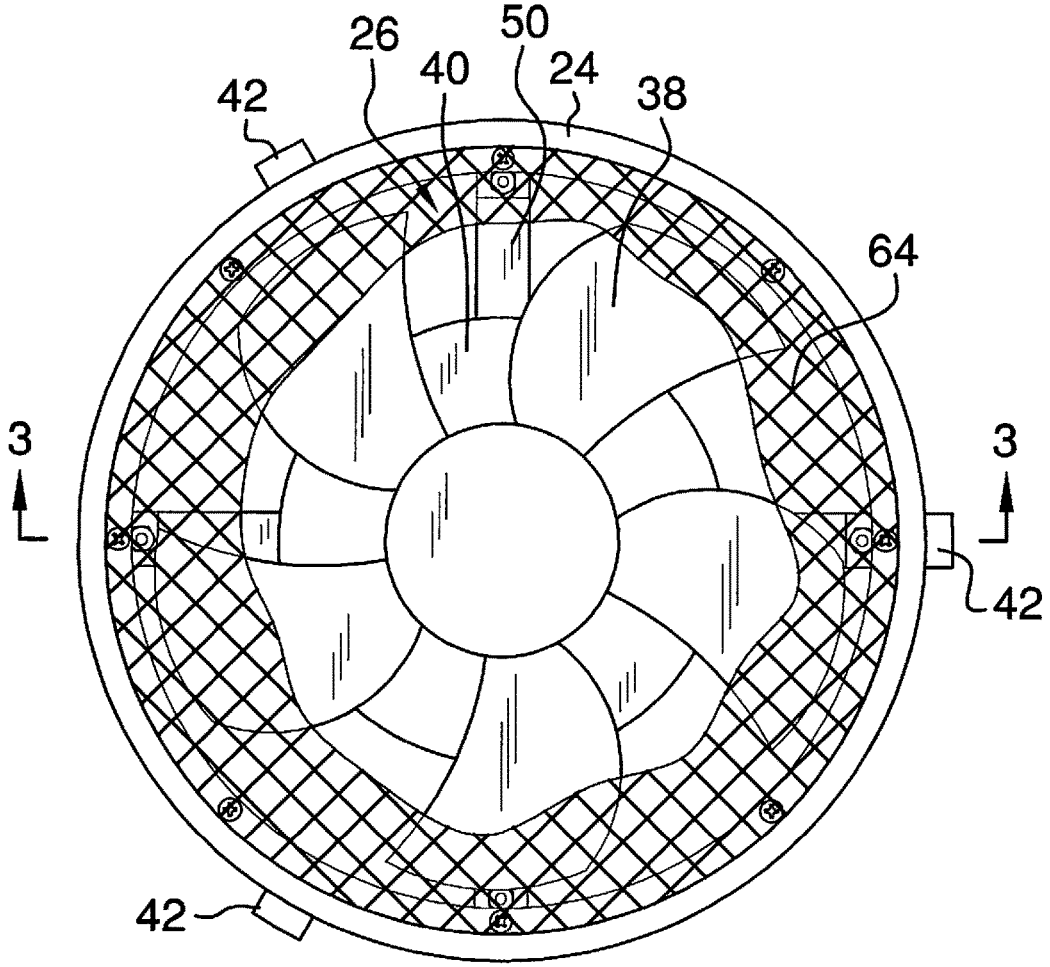
FIG. 2 is a bottom view of an embodiment of the disclosure.
Figure 3:
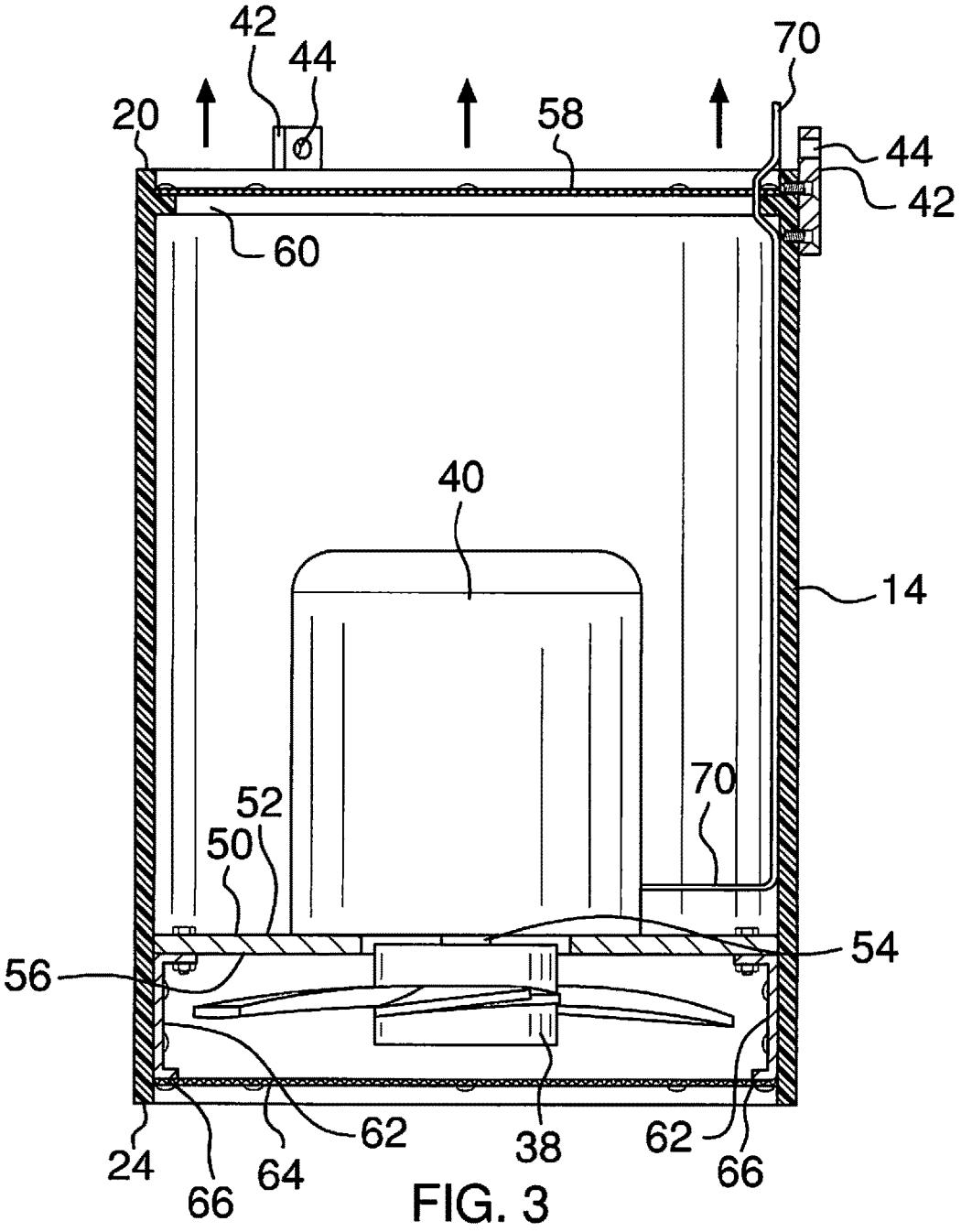
FIG. 3 is a cross-sectional view of an embodiment of the disclosure taken along line 3-3 of FIG. 2.
Figure 4:
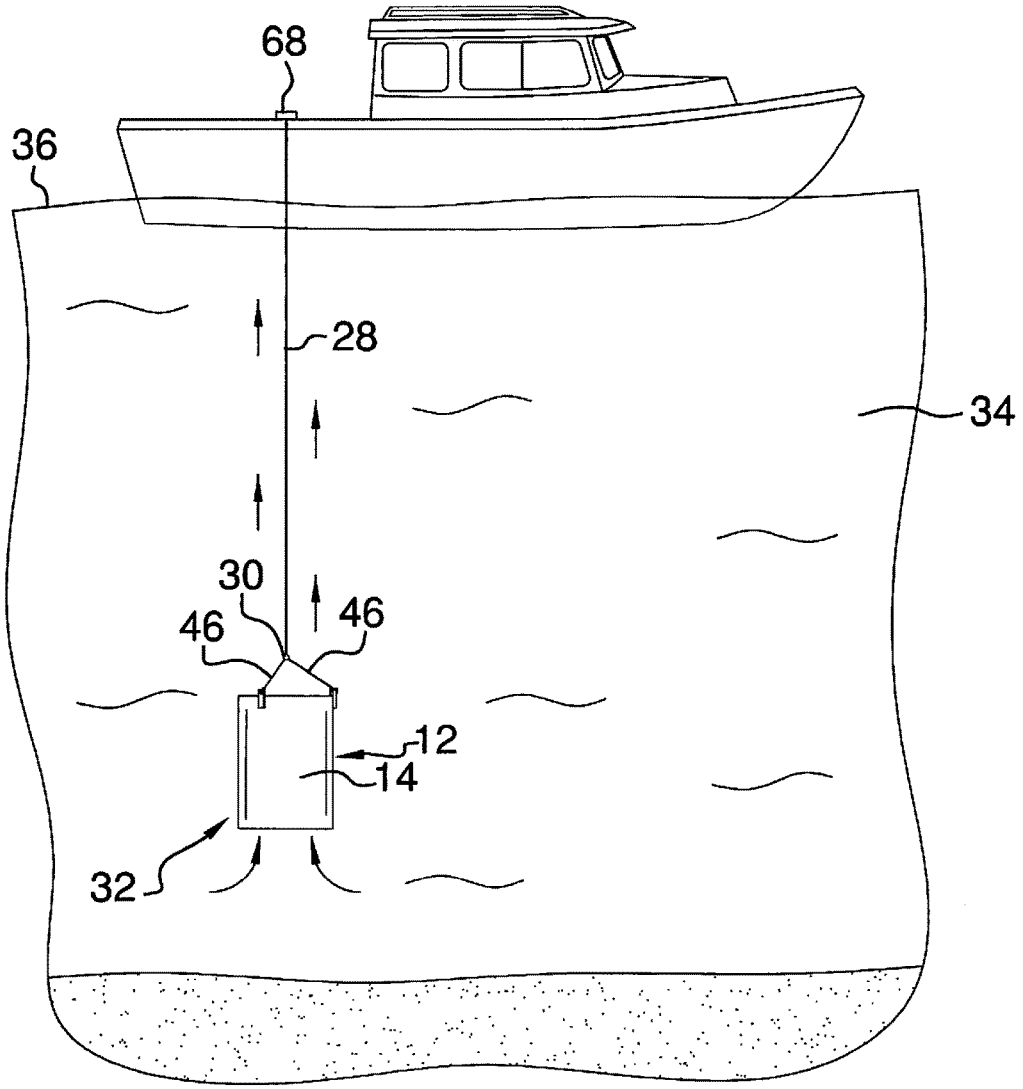
FIG. 4 is a side view of an embodiment of the disclosure in use.

With reference now to the drawings, and in particular to FIGS. 1 through 4 thereof, a new fan device embodying the principles and concepts of an embodiment of the disclosure and generally designated by the reference numeral 10 will be described.

As best illustrated in FIGS. 1 through 4, the aquatic fan device 10 generally comprises a tube 12 having a perimeter wall 14 extending between a top end 16 of the tube 12 and a bottom end 18 of the tube 12. A top edge 20 of the perimeter wall 14 defines a top opening 22 through the top end 16 and a bottom edge 24 of the perimeter wall 14 defines a bottom opening 26 through the bottom end 18. Thus, the tube 12 is configured for transmission of a fluid through the tube 12. A line 28 has a first end 30 coupled to the tube 12 such that the line 28 supports the tube 12 in a vertical position 32 when the tube 12 hangs from the line 28. The line 28 extends from the tube 12 wherein the line 28 is configured for suspending the tube 12 within a body of water 34 under a surface 36 of the body of water 34. A propeller 38 is coupled to the tube 12 and is positioned within the tube 12 between the top end 16 and the bottom end 18.

A motor 40 is coupled to the propeller 38. The motor 40 is functional when submersed in water. The motor 40 selectively rotates the propeller 38 wherein the propeller 38 is configured for urging water upwardly through the tube 12 towards the surface 36 of the body of water 34. Thus, when submerged, the motor 40 will direct cooler water found a distance below the surface 36 of the body of water 34 towards the surface 36.

A plurality of lugs 42 is coupled to the tube 12. Each lug 42 projects upwardly from the top opening 22 of the tube 12 away from the top edge 20 of the perimeter wall 14. Each lug 42 has a respective aperture 44 extending therethrough. Each of a plurality of line extensions 46 extends between the line 28 and an associated one of the lugs 42. Each line extension 46 has a lower end 48 coupled to the associated one of the lugs 42. Each line extension 46 may have an equivalent length and the lugs 42 may be evenly arranged around the top opening 22 wherein the line 28 is positioned substantially aligned with a longitudinal axis of the tube 12 when the tube 12 is suspended from the line 28.

A support bracket 50 may be coupled to and extend across the tube 12 at a position between the top end 16 and the bottom end 18. The motor 40 is coupled to the support bracket 50 and positioned between an upper surface 52 of the support bracket 50 and the top end 16 of the tube 12. An axle 54 may be coupled to and extend between the motor 40 and the propeller 38. The axle 54 may extend through the support bracket 50 such that the propeller 38 is positioned between a lower surface 56 of the support bracket 50 and the bottom end 18 of the tube 12.

A top screen 58 may be coupled to the tube 12 proximate the top opening 22. An upper lip 60 extends inwardly from the perimeter wall 14. The top screen 58 is coupled to and supported by the upper lip 60 such that the top screen 58 prevents contact with the motor 40 or propeller 38 to lessen the possibility of injury when the propeller 38 is activated by the motor 40. A spacing bracket 62 may be coupled to and extend downwardly from the support bracket 52. The spacing bracket 62 may alternatively be coupled directly to the perimeter wall 14 and positioned abutting the support bracket 50. A bottom screen 64 may be coupled to the tube 12 proximate the bottom opening 26. The bottom screen 64 is coupled to a lower edge 66 of the spacing bracket 62. The propeller 38 is positioned between the bottom screen 64 and the mounting bracket 50 to prevent contact with the propeller 38 and restrict objects from being drawing into the tube 12 through the bottom opening 26. A remote control 68 may be provided. The remote control 68 may be communicatively coupled to the motor 40 by direct wiring 70 or through wireless communication for selectively activating the motor 40 from a distance. Thus, the motor 40 is configured for being activated from above the surface 36 of the body of water 34.

In use, the tube 12 is suspended from a boat 72 or other float substantial enough to support the tube 12 without being drawn under the surface 36 of the body of water 34 while the motor 40 rotates the propeller 38. The motor 40 is activated to rotate the propeller 38 wherein cooler water from depths of the body of water 34 are drawn into and through the tube 12 and directed towards the surface 36. Thus, the device 10 provides a relatively cool area of water at or near the surface 36 to make swimming in the body of water 34 more comfortable or enjoyable.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An aquatic fan device comprising: a tube having a perimeter wall extending between a top end of said tube and a bottom end of said tube, a top edge of said perimeter wall defining a top opening through said top end, a bottom edge of said perimeter wall defining a bottom opening through said bottom end; a line having a first end coupled to said tube such that said line supports said tube in a vertical position when said tube hangs from said line, said line extending from said tube wherein said line is configured for suspending said tube within a body of water under a surface of the body of water; a propeller coupled to said tube, said propeller being positioned within said tube between said top end and said bottom end; and a motor coupled to said propeller, said motor being functional when submersed in water, said motor rotating said propeller wherein said propeller is configured for urging water upwardly through said tube towards the surface of the body of water; a support bracket coupled to and extending across said tube between said top end and said bottom end, said motor being coupled to said support bracket;

a spacing bracket comprising two extensions aligned radially inward toward said propeller, the spacing bracket being coupled to and extending downwardly from said support bracket; and a bottom screen being coupled to a lower edge of said spacing bracket.

2. The device of claim 1, further comprising a remote control communicatively coupled to said motor for selectively activating said motor from a distance wherein said motor is configured for being activated from above the surface of the body of water.

3. The device of claim 1, further comprising a top screen coupled to said tube proximate said top opening.

4. The device of claim 1, further comprising the bottom screen coupled to said tube proximate said bottom opening.

5. The device of claim 1, further comprising:

a plurality of lugs coupled to said tube, each said lug projecting upwardly from said top opening of said tube, each said lug having a respective aperture extending therethrough; and a plurality of line extensions, each line extension extending between said line and an associated one of said lugs, each said line extension having a lower end coupled to said associated one of said lugs.

6. The device of claim 1, further comprising an axle coupled to and extending between said motor and said propeller, said axle extending through said support bracket.

7. The device of claim 1, further comprising said motor being positioned between an upper surface of said support bracket and said top end of said tube.

8. The device of claim 1, further comprising said propeller being positioned between a lower surface of said support bracket and said bottom end of said tube.

9. The device of claim 3, further comprising an upper lip extending inwardly from said perimeter wall, said top screen being coupled to and supported by said upper lip.

10. The device of claim 1, further comprising said propeller being positioned between said bottom screen and said support bracket.

11. An aquatic fan device comprising: a tube having a perimeter wall extending between a top end of said tube and a bottom end of said tube, a top edge of said perimeter wall defining a top opening through said top end, a bottom edge of said perimeter wall defining a bottom opening through said bottom end; a line having a first end coupled to said tube such that said line supports said tube in a vertical position when said tube hangs from said line, said line extending from said tube wherein said line is configured for suspending said tube within a body of water under a surface of the body of water; a propeller coupled to said tube, said propeller being positioned within said tube between said top end and said bottom end; a motor coupled to said propeller, said motor being functional when submersed in water, said motor rotating said propeller wherein said propeller is configured for urging water upwardly through said tube towards the surface of the body of water; a plurality of lugs coupled to said tube, each said lug projecting upwardly from said top opening of said tube, each said lug having a respective aperture extending therethrough; a plurality of line extensions, each line extension extending between said line and an associated one of said lugs, each said line extension having a lower end coupled to said associated one of said lugs; a support bracket coupled to and extending across said tube between said top end and said bottom end, said motor being coupled to said support bracket, said motor being positioned between an upper surface of said support bracket and said top end of said tube, said propeller being positioned between a lower surface of said support bracket and said bottom end of said tube; an axle coupled to and extending between said motor and said propeller, said axle extending through said support bracket; a top screen coupled to said tube proximate said top opening; an upper lip extending inwardly from said perimeter wall, said top screen being coupled to and supported by said upper lip;

a spacing bracket comprising two extensions aligned radially inward toward said propeller, the spacing bracket being coupled to and extending downwardly from said support bracket; a bottom screen coupled to said tube proximate said bottom opening, said bottom screen being coupled to a lower edge of said spacing bracket, said propeller being positioned between said bottom screen and said mounting support bracket; and a remote control communicatively coupled to said motor for selectively activating said motor from a distance wherein said motor is configured for being activated from above the surface of the body of water.

* * * * *